US005327835A

United States Patent [19]

Adams et al.

[11] Patent Number: 5,327,835

[45] Date of Patent: Jul. 12, 1994

[54] DETONATION DEVICE INCLUDING COUPLING MEANS

[75] Inventors: Craig F. Adams, Granby; Richard J. Pebbles, Winchester, both of Conn.

[73] Assignee: The Ensign-Bickford Company, Simsbury, Conn.

[21] Appl. No.: 85,986

[22] Filed: Jul. 1, 1993

[51] Int. Cl.[5] ..... F42B 3/10; F42B 3/16; F42C 19/08

[52] U.S. Cl. ..... 102/275.11; 102/275.2; 102/275.3; 102/275.6; 102/275.7; 102/275.12

[58] Field of Search ..... 102/275.7, 275.12, 275.4, 102/275.2, 275.3, 275.5, 275.11, 275.6

[56] References Cited

U.S. PATENT DOCUMENTS

| | | | |
|---|---|---|---|
| 2,475,281 | 7/1949 | Hanley | 102/275.7 |
| 3,129,663 | 4/1964 | Schnepfe, Jr. | 102/275.4 |
| 3,260,202 | 7/1966 | Bryla | 102/275.5 |
| 3,460,477 | 8/1969 | Heidemann et al. | 102/275.2 |
| 3,590,739 | 7/1971 | Persson | 102/275.5 |
| 3,678,853 | 7/1972 | Kilmer | 102/275.4 |
| 3,981,240 | 9/1976 | Gladden | 102/275.5 |
| 3,990,367 | 11/1976 | Smith | 102/275.4 |
| 4,328,753 | 5/1982 | Kristensen et al. | 102/275.8 |
| 4,335,652 | 6/1982 | Bryan | 102/275.3 |
| 4,607,573 | 8/1986 | Thureson et a. | 102/275.8 |
| 4,608,926 | 9/1986 | Stevens | 102/275.4 |
| 4,699,059 | 10/1987 | Kelly et al. | 102/275.1 |
| 4,756,250 | 7/1988 | Dias dos Santos | 102/275.1 |
| 4,762,067 | 8/1988 | Barker et al. | 102/275.5 |
| 4,838,165 | 6/1989 | Gladden et al. | 102/275.8 |
| 4,846,067 | 7/1989 | Martin | 102/275.6 |
| 4,962,708 | 10/1990 | Snyder et al. | 102/275.11 |
| 4,998,477 | 3/1991 | Barker | 102/275.6 |
| 5,001,981 | 3/1991 | Shaw | 102/275.8 |
| 5,007,661 | 4/1991 | Lenzen | 102/275.8 |
| 5,010,821 | 4/1991 | Blain | 102/275.8 |
| 5,012,741 | 5/1991 | Peebles et al. | 102/275.4 |
| 5,020,435 | 6/1991 | Cawte | 102/275.1 |
| 5,166,470 | 11/1992 | Stewart | 102/275.5 |
| 5,171,935 | 12/1992 | Michna et al. | 102/275.7 |

FOREIGN PATENT DOCUMENTS

| | | |
|---|---|---|
| 249329 | 6/1953 | Australia . |
| 1200718 | 2/1986 | Canada . |
| 8808414 | 3/1988 | PCT Int'l Appl. . |
| 913747 | 12/1962 | United Kingdom . |
| 2027176 | 2/1980 | United Kingdom . |
| 2140137 | 11/1984 | United Kingdom . |
| 2255160 | 10/1992 | United Kingdom . |

*Primary Examiner*—David H. Brown

*Attorney, Agent, or Firm*—Victor E. Libert; Frederick A. Spaeth

[57] ABSTRACT

A coupling device (10) for coupling a detonator cap (22a, 22b) with a detonating cord (82) features a sleeve member (12) having a longitudinal bore (18) extending therethrough for receiving a detonator cap (22a, 22b) in one end and a detonating cord (82) in the other. The coupling device (10) includes a nut member (14) having an aperture for receiving the cord (82) and having a compression surface (34) for bearing against a compression portion defined below when the nut member (14) is secured onto the sleeve member (12). The nut member (14) may be secured to the sleeve member (12) with its aperture aligned with the bore (18). A compression portion (31) associated with the sleeve member (12) responds to pressure from the compression surface (34) of the nut member (14) for gripping a cord (82) when the nut member (14) is secured onto the sleeve member (12). Thus, a cord can be securely disposed in detonation signal transmission relation to a cap without having special coupling hardware, e.g., a mounting ferrule, on the cord. The sleeve member optionally includes a ferrule seat (28) for receiving a ferrule (16), dimensioned and configured to receive a detonating cord and to allow the cord to pass into the bore. The ferrule (16) may include the compression portion means, which may include a plurality of resilient tangs (32a, 32b) disposed about the bore.

12 Claims, 2 Drawing Sheets

DETONATION DEVICE INCLUDING COUPLING MEANS

BACKGROUND OF THE INVENTION

Field of the Invention

This invention relates to a device for use in the initiation of a linear pyrotechnic or explosive means such as detonating cord, and more particularly, to a device for coupling a detonating cap to detonating cord.

In mining and other blasting operations, it is often necessary to join two linear members in signal transmission relationship, such as one detonation signal transmission line to another, or to a linear pyrotechnic or explosive member, so that a detonation signal may pass from one to the other. One of such linear devices may be, e.g., a signal transmission line such as shock tube, which generally comprises a hollow tube which has a coating of a reactive material, e.g., pulverulent PETN or a mixture of powdered aluminum and a pulverulent explosive, on its interior wall. See, e.g., U.S. Pat. No. 3,590,739 to Persson, dated Jul. 6, 1971 and U.S. Pat. No. 4,607,573 to Thureson et al dated Aug. 26, 1986. It is often necessary to amplify a signal by use of a detonator cap in order to initiate another device or signal transmission line. Accordingly, a signal transmission line such as a shock tube may be connected at one end with a detonator cap which is detonated by the ignition signal transmitted through the shock tube and which releases, upon detonation, energy sufficient to detonate another device to which the initiation signal is thus transferred. The prior art reflects a knowledge of a variety of coupling devices by which the detonator cap is disposed in signal transmission relation to a target device.

U.S. Pat. No. 3,129,663 to Schnepfe, Jr., dated Apr. 21, 1964 discloses a fitting for low energy detonating cord. The fitting or coupling 10 joins two lengths of low energy detonating cord (LEDC) each of which has a booster cup 21 crimped at their respective ends. The coupling 10 has a longitudinal bore therethrough dimensioned and configured to receive the ends of the respective LEDC lines such that the booster cups are adjacent to one another within the coupling. Further, each LEDC has a ferrule crimped thereto providing a flange, e.g., 24, which bears against the end 27 of the coupling. The LEDC passes through a threaded connector cap 38 which cooperates with corresponding threads at the ends 27 of coupling 10, to clamp flange 24 therebetween when cap 38 is secured onto end 27. Coupling 10 is also provided with relief vents 41 that are protected by bushings 43. The ends of both LEDC lines must be equipped with the crimped ferrules in order for the coupling to function.

U.S. Pat. No. 3,460,477 to Heidemann et al, dated Aug. 12, 1969 discloses a one-way detonation transfer device that features opposing threaded wells for receiving the ends of detonating cords having threaded fixtures secured thereto.

SUMMARY OF THE INVENTION

The present invention provides a coupling device for coupling a detonator cap with a detonating cord in signal transmitting relationship, that is, so that detonation of the detonating cap will detonate the detonating cord, the coupling device of the invention providing a quick-acting, waterproof connection.

More specifically, in accordance with the present invention, there is provided a detonation coupling device comprising means for coupling a detonator cap with a detonating cord, the device comprising the following components. A sleeve member has a longitudinal sleeve bore extending therethrough. The sleeve bore has a cap-receiving portion dimensioned and configured to receive a detonator cap, and a cord-receiving portion dimensioned and configured to receive a detonating cord in signal transmission relation to the detonator cap. A fastener member has a fastener aperture dimensioned and configured to receive therethrough a detonating cord. There are sleeve engagement means on the sleeve member and complementary fastener engagement means on the fastener member, the respective engagement means cooperating to secure the fastener member to the sleeve member with the fastener aperture aligned with the cord-receiving portion of the sleeve bore. There are also sleeve compression means carried on the sleeve member and complementary fastener compression means carried on the fastener member, the respective compression means cooperating to grip a detonating cord disposed in the cord-receiving portion of the sleeve bore when the fastener member is secured to the sleeve member.

One aspect of the invention provides a detonator cap disposed in the cap-receiving portion of the sleeve bore for detonating a detonating cord disposed in the cord-receiving portion of the sleeve bore, and a signal transmission line having one end connected in signal communication with the detonator cap and an opposite, distal end.

Another aspect of the invention further provides an initiator for producing an ignition signal. The initiator is connected to the distal end of the signal transmission line for producing an initiation signal to be transmitted from the initiator to the detonator cap via the signal transmission line.

In accordance with another aspect of the invention, the sleeve compression means comprises a ferrule seat and a compressible ferrule disposed on the ferrule seat. The ferrule, which optionally may comprise a plurality of resilient tangs disposed about a seat section, has an annular configuration defining a ferrule aperture dimensioned and configured to receive a detonating cord therein. In this aspect, the fastener compression means comprises a compression surface dimensioned and configured to compress the ferrule when the fastener member is secured to the sleeve member.

In accordance with another aspect of the invention, the coupling device comprises a resilient material able to withstand substantially without producing shrapnel the release of energy upon detonation of a detonator cap in the sleeve member and to contain the shrapnel produced by the detonator cap. Alternatively, the coupling device may be comprised of a friable material which, upon detonation of the detonator cap disposed in the cap-receiving end of the sleeve bore, disintegrates without substantial production of shrapnel.

Optionally, any of the foregoing embodiments may be combined with a shipping plug dimensioned and configured to be received in the cord-receiving end of the sleeve bore and retained therein when the fastener member is secured onto the sleeve member.

Preferably, a detonator cap used in conjunction with the coupling device comprises a directional detonator element for directing the energy of the detonation to the detonating cord. A suitable directional detonator element may comprise a cylindrical bushing having an axial bore within which is disposed a detonation charge. The bushing may be dimensioned and configured to direct the energy released by the detonation charge therein toward a detonating cord disposed in the sleeve bore.

DETAILED DESCRIPTION OF THE INVENTION AND PREFERRED EMBODIMENTS THEREOF

The present invention relates to a coupling device which may be used to couple a detonator cap to the end of a detonating cord. The invention allows for a secure, reliable connection between a detonator cap and the detonating cord without the need for affixing specially adapted hardware to the end of the detonating cord. Generally, this advantage is achieved by providing a coupling device into which an end of a detonating cord can be inserted and secured by a mechanism that can grip the cord after it is in place. Such a mechanism generally comprises a compression portion or the like that is disposed in close proximity to the cord and that can be compressed to grip and thus retain the cord in the coupling device, where it may be disposed for detonation by a suitable device, e.g., a detonator cap. Thus, detonating cord can be measured and cut in the field and easily coupled to a detonation device with a minimum of inconvenience.

Optionally, a detonator cap may be factory-assembled to the coupling device to provide a detonation device that is easily and quickly coupled to a detonating cord. A signal transmission line such as a shock tube may be factory-assembled to the detonator cap; and an ignition device may optionally be factory-assembled to the distal end of the signal transmission line to provide a self-contained device which can be quickly connected to a detonating cord.

Figure 1:
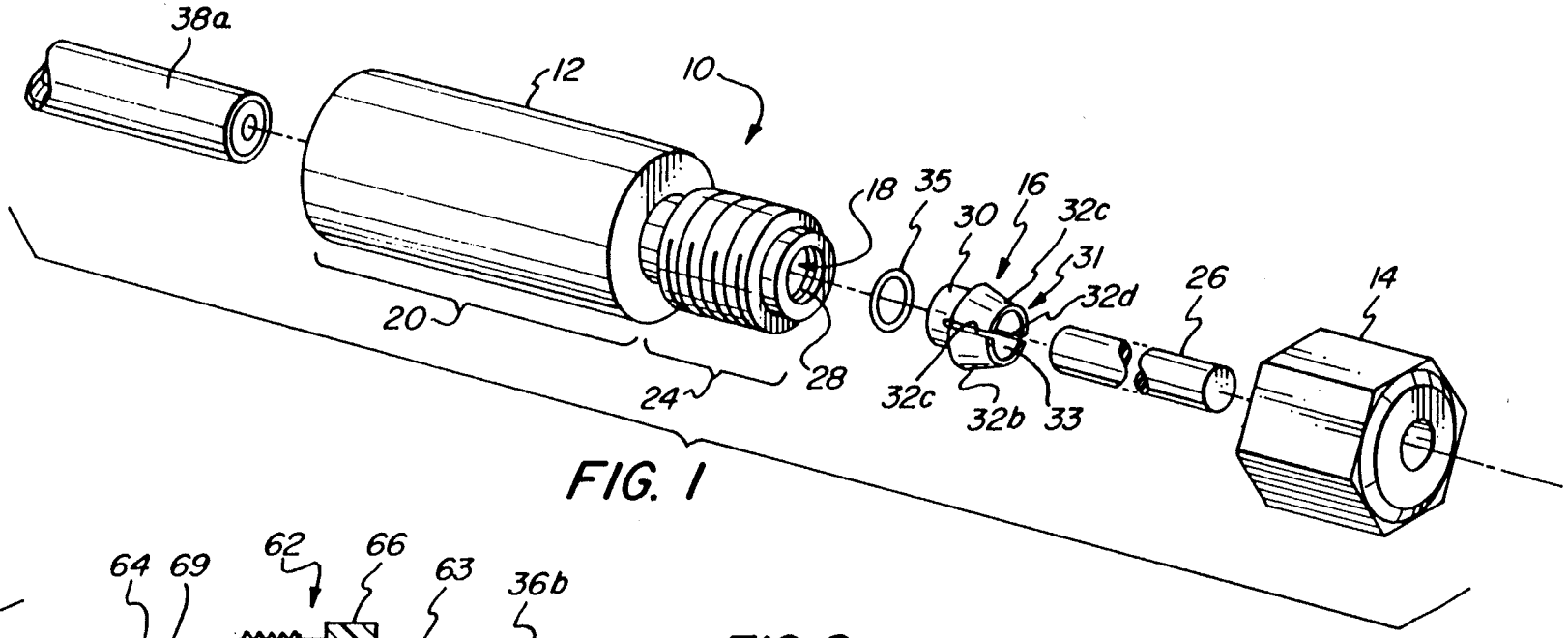
FIG. 1 is a perspective exploded view of a coupling device according to one embodiment of the present invention.
Figure 2:
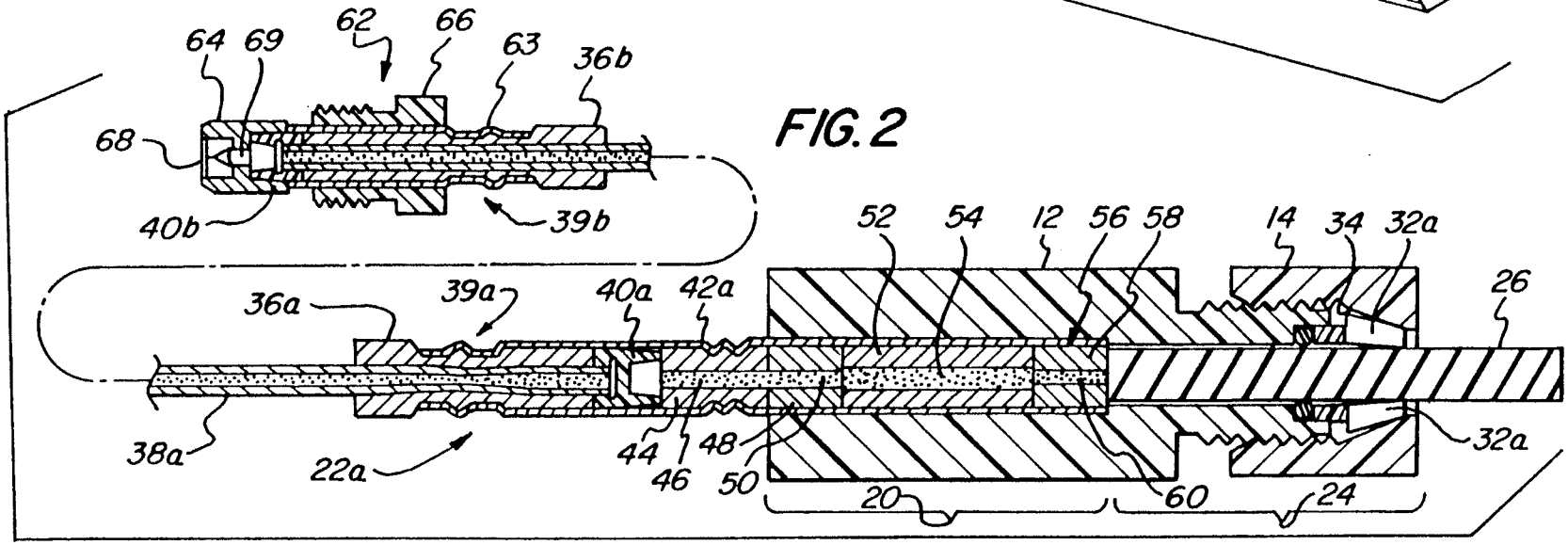
FIG. 2 is a schematic cross-sectional view of a connector device according to the present invention associated with a detonation device and having a plug to facilitate handling without contamination by water or debris.

As shown in FIG. 1 and FIG. 2, a coupling device 10 according to one embodiment of the present invention may comprise a sleeve member 12 and a fastener member provided in the illustrated embodiment by a nut member 14. Sleeve member 12 has a longitudinal sleeve bore 18 having a cap-receiving portion 20 dimensioned and configured to receive a detonator cap 22*a* and a cord-receiving portion 24 dimensioned and configured to receive a detonating cord or, as seen in FIG. 2, a shipping plug 26 dimensioned and configured to simulate a detonating cord.

Sleeve member 12 is equipped with a ferrule seat 28 for receiving a ferrule 16. Ferrule 16, which has a seat section 30 dimensioned and configured to be received in the ferrule seat 28 of sleeve member 12 is configured to have an annular configuration defining a ferrule aperture 33 (FIG. 1) for receiving a detonating cord. When ferrule 16 is disposed with seat section 30 in ferrule seat 28, the ferrule aperture 33 is aligned with the cord-receiving portion of bore 18, so that a detonating cord can pass easily through the ferrule aperture 33 into the cord-receiving portion of the sleeve bore. With the ferrule so situated, the ferrule aperture can be considered to be an extension of the cord-receiving portion of the sleeve bore.

Ferrule 16 also comprises a compression portion 31 which, in response to a compression force applied thereto, constricts the ferrule aperture and thus grips a detonating cord or shipping plug disposed therein. Thus, as shown in FIG. 2, the compression portion 31 of ferrule 16 may comprise at least one slot (such as slots 32*c*, 32*d* of FIG. 1, not shown in FIG. 2) and two or more resilient tangs 32*a*, 32*b* defined by the slots. Tangs 32*a*, 32*b* are disposed about the ferrule aperture and thus about the sleeve bore. Ferrule 16 thus provides a sleeve compression means to sleeve member 12. Nut member 14 is equipped with a complementary compression means provided by compression surface 34 which, when nut member 14 is secured onto sleeve member 12, applies a compression force on compression portion 31, which can then grip a detonating cord that may be disposed in the ferrule aperture. Thus, when nut member 14 is secured onto sleeve member 12, compression surface 34 bears upon tangs 32*a*, 32*b* and causes them to flex into and thus constrict the sleeve bore to grip a detonating cord disposed therein.

In the illustrated embodiments, the compression portion of the coupling device is embodied in a ferrule that is seated on the sleeve member but which is a physically separate structure. In other embodiments of the invention, the ferrule 16 could be seated on the fastener member, e.g., nut member 14. Further, it will be appreciated that in still other embodiments of the invention, the compression portion, e.g., resilient tangs, may be formed integrally with either the sleeve member 12 or the nut member 14.

Detonating cord, as is known, typically comprises a linear core of explosive material such as PETN, enclosed in a waterproof casing. The waterproof casing is advantageous since detonating cord is often used outdoors where it is exposed to the elements and because moisture impairs the effectiveness of the explosive material. However, when the cord is cut, the exposed core is vulnerable to water contamination. Therefore, coupling device 10 preferably further comprises sealing means to provide a water-tight seal between sleeve member 12 and the detonating cord therein when nut member 14 is secured onto sleeve member 12. Such sealing means may comprise an O-ring 35 dimensioned and configured to receive the end of the detonating cord therein and is positioned to sealingly bear against sleeve member 12 and the shipping plug or detonating cord when the fastener member, e.g., nut member 14 is secured onto sleeve member 12, to prevent the introduction of water into the sleeve bore where the exposed core of the detonating cord will be disposed. When the coupling device comprises ferrule 16, O-ring 35 may be disposed in the ferrule seat between ferrule 16 and the associated sleeve member or fastener member, so that when the fastener member is secured onto the sleeve member, the resulting compressive force not only causes the compression portion to grip the detonating cord (or shipping plug) as described above, but also causes the O-ring to bear more firmly against the detonating cord (or shipping plug) and the sleeve member. Accordingly, O-ring 35 is dimensioned and configured to receive shipping plug 26 and to be received in ferrule seat 28.

Figure 3:
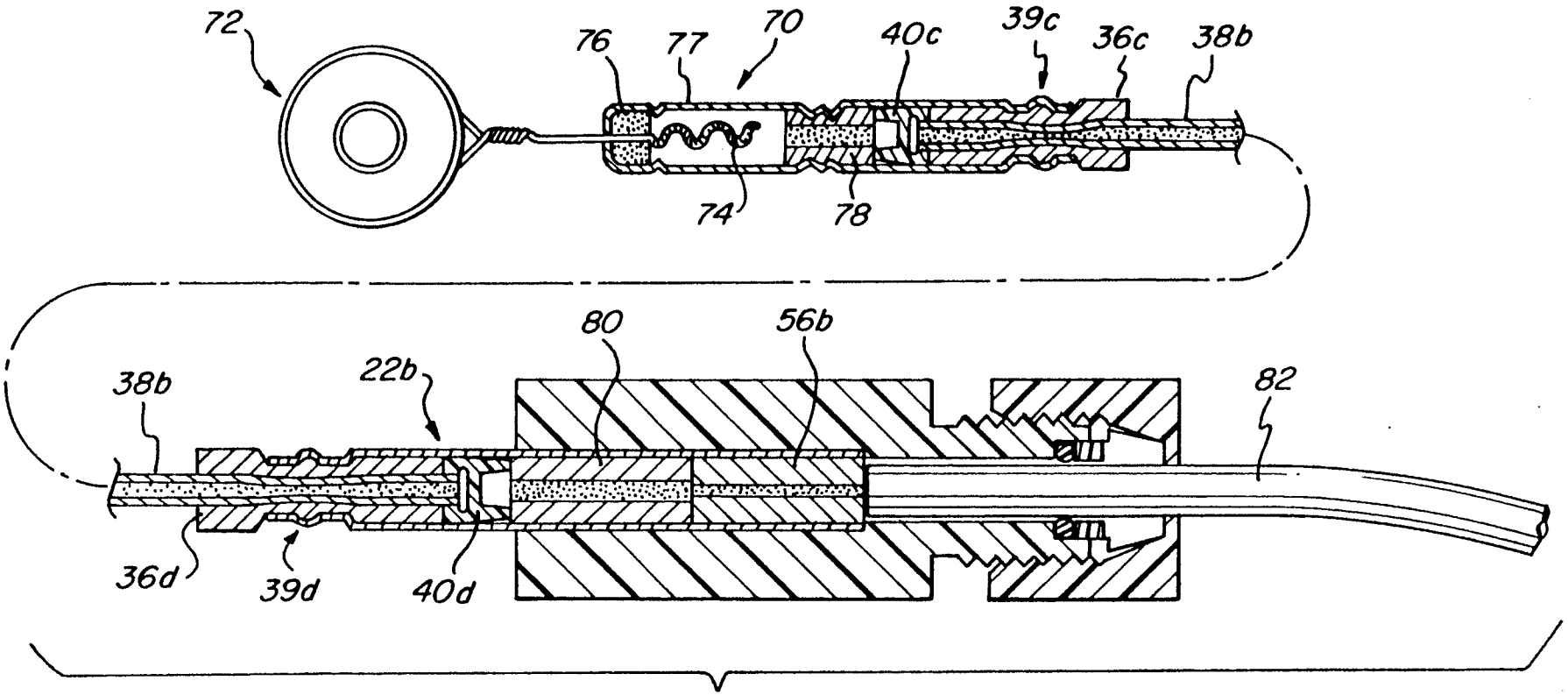
FIG. 3 is a schematic cross-sectional view of a connector device according to the present invention having a detonation device with an initiator different from that of FIG. 2 and having a detonating cord positioned therein for detonation.

The sleeve member 12 and nut member 14 comprise respective engagement means that cooperate to allow the user to secure the nut member 14 onto sleeve member 12. In the illustrated embodiments, the sleeve engagement means and the fastener member (nut 14) engagement means are provided by intermeshing threads that allow nut member 14 to be screwed onto sleeve member 12, causing compression surface 34 to bear upon the compression portion of ferrule 16. However, it will be appreciated that any other suitable complementary engagement means may be employed in place of threads, e.g., a detent and fence arrangement may be used. Preferably, the engagement means are releasable so that nut member 14 may be secured to sleeve member 12 to cause tangs 32*a*, 32*b* of the compression portion 31 of ferrule 16 to retain shipping plug 26 in sleeve member 12, and may subsequently be loosened so that shipping plug 26 may be removed and the end of a detonating cord may be inserted into the cord-receiving portion 24 of sleeve member 12. Nut member 14 may then be re-secured to sleeve member 12 to retain the detonating cord 82 therein as shown in FIG. 3.

Detonator cap 22*a*, shown in FIG. 2, is a shock tube-sensitive blasting cap comprising a bushing 36*a* through which a shock tube 38*a* is received, and which cooperates with crimp 39*a* to secure shock tube 38*a* in shell 42*a*. The end of shock tube 38*a* bears against an isolation cup 40*a* which, as is known in the art, serves to reduce the chance of premature detonation of detonator cap 22*a* by diverting any static electricity that may develop on shock tube 38*a* away from the detonating charge of detonator cap 22*a* and towards metal shell 42*a*. Such isolation cups are described in U.S. Pat. No. 3,981,240 to Gladden, dated Sep. 21, 1976, which is hereby incorporated herein by reference.

Isolation cup 40*a* bears against sealer element 44 which has a core 46 of pyrotechnic material. Adjacent to sealer element 44 is a starter element 48 which has a core 50 of pyrotechnic material. The detonator cap in the embodiment of FIG. 2 is of a delay type and therefore comprises a delay element 52 having a relatively slow burning core 54. After the desired delay, which is typically of a duration of milliseconds, the initiation signal is transmitted to the detonator charge element 56, which then detonates to initiate detonation of a detonating cord disposed in the cord-receiving portion 24 of bore 18. Preferably, the detonator element 56 comprises a cylindrical stainless steel bushing 58 having therein an axially disposed detonatable core 60 comprising a suitable quantity of detonatable material, e.g., lead azide. Preferably, bushing 58 is made of a material such as stainless steel and of a thickness sufficient to withstand the detonation of core 60 and thus inhibits the release of energy in radial directions from the core. Accordingly, the energy released upon the detonation of core 60 will be directed longitudinally toward the end of detonator cap 22*a*, and thus toward a detonating cord to be situated in place of plug 26. Detonator element 56 can therefore be described as a directional detonator element.

As seen in FIG. 2, detonator cap 22*a* is associated with an initiator and a signal transmission line provided by a shock tube 38*a*. The shock tube is connected to the detonator cap at one end to provide signal communication between the cap and the initiator at the opposite, distal end, to provide an initiation-detonation device. In the embodiment of FIG. 2, initiator 62 is a percussive initiator comprising a shell 63 that includes an end fitting 64 which is dimensioned and configured to be received within a percussive triggering device, e.g., a flare gun (not shown), and to be secured therein by means of a hex nut 66. End fitting 64 carries a primer cap 68, such as those sold by Olin Corporation under the designation M42C1, which can be initiated by a percussive strike received from the triggering device. Primer cap 68 faces an isolation cup 40*b* through an intervening through hole 69. The end of shock tube 38*a* is disposed against the side of isolation cup 40*b*, opposite from primer cap 68 and is retained in the shell by bushing 36*b* and crimp 39*b*.

As shown in FIG. 2, it is preferred to ship and handle a detonating device with a shipping plug 26 secured in the cord-receiving end of sleeve member 12 prior to inserting the end of a detonating cord therein. Shipping plug 26 serves to inhibit the introduction of moisture and foreign materials which might otherwise enter sleeve bore 18 of sleeve member 12 during shipping and handling of a detonating device and later interfere with detonation of a detonating cord therein. Shipping plug 26 also serves to contain any reaction by-products within the unit in the event of inadvertent initiation in the shipping configuration. Such containment is advantageous for preventing sympathetic detonation of adjacent reactive materials. When the user is ready to secure a detonating cord in the coupling device, nut member 14 may be released from sleeve member 12, allowing ferrule 16 to "ungrip" shipping plug 26, which may then be removed. The end of a detonating cord may then be inserted through the apertures in nut member 14 and ferrule 16 into the cord-receiving end of sleeve member 12, and nut member 14 may then be re-secured onto sleeve member 12 so that ferrule 16 grips and retains the detonating cord therein.

One of the problems encountered by users of detonating devices is that the blasting cap and associated coupling device can release shrapnel that can cause injury. In one aspect, the present invention serves to alleviate this problem by providing a coupling device which absorbs or disperses the energy released upon detonation of the detonator cap. For example, a coupling device 10 may comprise a friable material which, upon being subjected to the detonation of a detonator cap disposed therein, disintegrates into powder-like particles of low mass. The kinetic energy of the powder particles is readily absorbed by the surrounding air so that persons disposed within a relatively close range of the detonation are not injured by the particles. A suitable test for the safety of a coupling device is to detonate the device at a distance of about 18 inches (45.72 cm) from a witness board, which may be a sheet of stencil oil board, but which may be a sheet of any yielding material on which the impact of hazardous shrapnel particle will be evident. The absence of damage to the witness board indicates that no substantial amounts of shrapnel were produced by the detonation. Materials that yield safe coupling devices may include such materials as rigid foam urethane and machineable waxes, which would be expected to produce little or no fragmentation, i.e., shrapnel, hazards. In a test trial, a coupling device made from a rigid foam polyurethane sold by the General Plastics Company under the designation 3715, was used to couple a detonating cord to a detonator cap that was detonated at a distance of 18 inches (45.72 cm) from a witness board made from stencil oil board that showed no resulting damage. The coupling device, rather than disintegrating substantially into hazardous, shrapnel-like particles, disintegrated substantially into powder without producing substantial amounts of shrapnel fragments. Conversely, coupling device 10 may comprise a resilient material such as 60 Shore A durometer Santoprene TM rubber, which is available from the Monsanto Company. A coupling device made from this material was demonstrated to be strong enough to withstand the detonation of the detonator cap without itself producing hazardous shrapnel and to contain the shrapnel produced by the detonator cap. Other such materials might include, for example, synthetic elastomeric spring rubbers such as 45 durometer Santoprene TM, molded and extruded urethanes, polyethylenes, and thermoplastic rubbers. Such materials may expand or fracture upon detonation but will not fragment into hazardous shrapnel.

The initiation-detonation device shown in FIG. 2 allows the user to send an initiation signal from a triggering device at a remote distance from detonator cap 22*a* and from the detonating cord that may be disposed in coupling device 10, and thus provides a degree of safety to the user. In use, initiator 62 is attached to a triggering device which percussively detonates primer cap 68. The energy released upon detonation penetrates isolation cup 40*b* and initiates a signal in shock tube 38*a*. The initiation signal travels the length of shock tube 38*a*, penetrates isolation cup 40*a* and passes through sealer element 44 to starter element 48. The signal is received by delay element 52 from starter element 48, and after a pre-determined delay, delay element 52 detonates detonator element 56. As discussed above, bushing 58 tends to focus the energy released by the explosive core 60 of detonator element 56 onto the end of a detonating cord disposed in the coupling device in place of plug 26.

FIG. 3 shows the coupling device 10 of FIG. 2 used in conjunction with a different kind of initiation-detonation device that comprises, instead of a percussive initiator, an alternative, conventionally known pull-ring type initiator 70. As is known in the art, initiator 70 may comprise a pull-ring 72 which draws a phosphorus-coated wire 74 through a scratch plug 76 situated in shell 77, producing a flame that sets off an ignition element 78. The initiation signal produced by ignition element 78 penetrates isolation cup 40*c* and passes to shock tube 38*b* which is retained in shell 77 by bushing 36*c* and crimp 39*c*. The initiation signal travels to detonator cap 22*b* via shock tube 38*b*. Detonator cap 22*b* comprises a bushing 36*d* and crimp 39*d* for retaining shock tube 38*b* therein. In detonator cap 22*b*, the initiation signal travels through isolation cup 40*d* to ignition element 80 and thence to a directional detonator element 56*b* that is configured similarly to detonator element 56*a* to focus its energy output to the end of detonating cord 82.

While the invention has been described in detail with reference to particular embodiments thereof, it will be apparent that upon a reading and understanding of the foregoing, numerous alterations to the described embodiments will occur to those skilled in the art and it is intended to include such alterations within the scope of the appended claims.

What is claimed is:

1. A detonation coupling device comprising means for coupling a detonator cap with a detonating cord, the device comprising:

a sleeve member having a longitudinal sleeve bore extending therethrough, the sleeve bore having a cap-receiving portion dimensioned and configured to receive a detonator cap and a cord-receiving portion dimensioned and configured to receive a detonating cord in signal transmission relation to the detonator cap;

a fastener member having a fastener aperture dimensioned and configured to receive therethrough a detonating cord;

sleeve engagement means on the sleeve member and complementary fastener engagement means on the fastener member, the respective engagement means cooperating to secure the fastener member to the sleeve member with the fastener aperture aligned with the cord-receiving portion of the sleeve bore; and sleeve compression means carried on the sleeve member and complementary fastener compression means carried on the fastener member, the respective compression means cooperating to grip a detonating cord disposed in the cord-receiving portion of the sleeve bore when the fastener member is secured to the sleeve member.

2. The device of claim 1 in combination with a shipping plug snugly received in the cord-receiving portion of the longitudinal sleeve bore.

3. The device of claim 2 wherein the detonator cap has a closed end and the directional detonator element comprises a cylindrical bushing received within the closed end and having an axial bore within which is disposed an explosive charge, the bushing being dimensioned and configured to direct the energy released by detonation of the explosive charge toward the detonating cord disposed in the sleeve bore.

4. The device of claim 1 further comprising a detonator cap disposed in the cap-receiving portion of the sleeve bore for detonating a detonating cord disposed in the cord-receiving portion of the sleeve bore, and a signal transmission line having one end in signal communication with the detonator cap and having an opposite, distal end.

5. The device of claim 4 further comprising an initiator connected to the distal end of the signal transmission line, for producing an initiation signal to be transmitted from the initiator to the detonator cap via the signal transmission line.

6. The device of claim 4 or claim 5 wherein the detonator cap comprises a directional detonator element for directing the energy of the detonation to the detonating cord.

7. The device of claim 1, claim 4 or claim 5 wherein the coupling device comprises a resilient material able to withstand substantially without producing shrapnel the release of energy upon detonation of a detonator cap in the sleeve member and to contain the shrapnel produced by the detonator cap.

8. The device of claim 1, claim 4 or claim 5 wherein the coupling device is comprised of a friable material which, upon detonation of a detonator cap disposed in the cap-receiving end of the sleeve bore, disintegrates without substantial production of shrapnel.

9. The device of claim 1, claim 4 or claim 5 wherein the sleeve compression means comprises a ferrule seat and a compressible ferrule disposed on the ferrule seat, the ferrule having an annular configuration defining a ferrule aperture dimensioned and configured to receive a detonating cord therein, and the fastener compression means comprises a compression surface dimensioned and configured to compress the ferrule when the fastener member is secured to the sleeve member.

10. The device of claim 9 wherein the ferrule comprises a plurality of resilient tangs disposed about a seat section.

11. The device of claim 9 further comprising sealing means disposed about the sleeve bore for sealing the sleeve bore against leakage of water therein.

12. The device of claim 11 wherein the sealing means comprises an O-ring disposed between the sleeve member and the ferrule.

* * * * *

UNITED STATES PATENT AND TRADEMARK OFFICE

CERTIFICATE OF CORRECTION

PATENT NO. : 5,327,835

DATED : July 12, 1994

INVENTOR(S) : Craig F. Adams et al

It is certified that error appears in the above-indentified patent and that said Letters Patent is hereby corrected as shown below:

On the title page, item [75]inventors: Correct inventor's name by changing "Pebbles" to --Peebles--.

Signed and Sealed this

Fourteenth Day of February, 1995

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,327,835

DATED : July 12, 1994

INVENTOR(S) : Craig F. Adams et al

It is certified that error appears in the above-indentified patent and that said Letters Patent is hereby corrected as shown below:

Column 8:

Renumber original claim 3 as claim 6 and change its dependency by deleting "claim 2" from the first line thereof and replacing it with --claim 5--.

Renumber original claim 4 as claim 3.

Renumber original claim 5 as claim 4 and conform its dependency to the renumbered claims by deleting "claim 4" from the first line thereof and replacing it with --claim 3--.

Renumber original claim 6 as claim 5 and conform its dependency to the renumbered claims by deleting from the first line thereof the phrase "claim 4 or claim 5" and replacing it with --claim 3 or claim 4--.

In each of claims 7, 8 and 9, conform the dependencies thereof to the renumbered claims by deleting from line 1 of each of these claims "4 or claim 5" and replacing it with --3 or claim 4--.

Signed and Sealed this

Eighth Day of August, 1995

*Attest:*

Bruce Lehman

BRUCE LEHMAN

*Attesting Officer*

*Commissioner of Patents and Trademarks*